US008475211B2

(12) United States Patent
Wang et al.

(10) Patent No.: US 8,475,211 B2
(45) Date of Patent: Jul. 2, 2013

(54) ELECTRICAL CONNECTOR ADAPTED FOR PLURAL DIFFERENT MATING CONNECTORS

(75) Inventors: Chen-Xi Wang, Kunshan (CN); Hong-Qiang Han, Kunshan (CN); Zi-Qiang Zhu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 55 days.

(21) Appl. No.: 13/165,716

(22) Filed: Jun. 21, 2011

(65) Prior Publication Data

US 2011/0312200 A1 Dec. 22, 2011

(51) Int. Cl.
*H01R 13/648* (2006.01)

(52) U.S. Cl.
USPC ..... 439/607.38; 439/660

(58) Field of Classification Search
USPC ..... 439/79, 80, 83, 101, 108, 607.01, 439/607.04, 607.35–607.38, 660, 939
See application file for complete search history.

(56) References Cited

U.S. PATENT DOCUMENTS 7,090,540 B2 * 8/2006 Masumoto et al. ..... 439/660
7,402,080 B2 * 7/2008 Xiao et al. ..... 439/607.2
7,722,407 B2 * 5/2010 Momose ..... 439/638
7,806,735 B1 * 10/2010 Chen et al. ..... 439/676
7,862,378 B1 * 1/2011 Wan et al. ..... 439/607.35
7,942,704 B2 * 5/2011 Ko et al. ..... 439/660
8,079,874 B2 * 12/2011 Lee et al. ..... 439/607.32
2005/0048839 A1 * 3/2005 Zhang ..... 439/607

FOREIGN PATENT DOCUMENTS

CN 201397899 2/2010

OTHER PUBLICATIONS

Universal Serial Bus Micro-USB Cables and Connectors Specification, Apr. 4, 2007, pp. 10-32.

* cited by examiner

*Primary Examiner* — Thanh Tam Le
(74) *Attorney, Agent, or Firm* — Wei Te Chung; Ming Chieh Chang

(57) ABSTRACT

An electrical connector adapted for at least two different mating connectors, comprises an insulative housing and a plurality of contacts retained on the housing. The insulative housing has a base and a tongue forwardly extending from the base. Each contact has a retaining portion retained in the base, a contact portion extending to the tongue from one end of the retaining portion, and at least one soldering portion extending out of the insulative housing from another end of the retaining portion. The contacts comprise two pairs of outer contacts at two sides thereof and at least one middle contact between said two pairs of outer contacts to connect with one contact of one mating connector or two contacts of another mating connector.

11 Claims, 20 Drawing Sheets

ELECTRICAL CONNECTOR ADAPTED FOR PLURAL DIFFERENT MATING CONNECTORS

BACKGROUND OF THE INVENTION

1. Field of the Invention

The present invention relates to an electrical connector, and more particularly to an electrical connector adapted for plural different mating connectors.

2. Description of Related Art

Different electronic devices connect with each other by a plurality of electrical connectors connecting with a number of cables with mating connectors corresponding to the electrical connectors. Micro Universal Serial Bus (Micro USB) connectors are widely used on Digital cameras, Mobile phones and MP3 et al. for adapting the small volume of the Digital cameras, Mobile phones and MP3 et al. The Hi-Speed rate of Micro USB connector widely used in market is up to 480 Mbit/s.

However, as the development of electric industry, even the USB 2.0 can not satisfy the requirement of many electronic devices. In April 2009, a new connector, Digital Interface for Video and Audio (DiiVA) is released by China Video Industry Association, and the Hi-Speed rate of DiiVA connector is up to 10 GB/s, which can satisfy the requirement of many electronic devices in nowadays. A Mini DiiVA connector especially designed for small electronic device is disclosed in China Patent No. CN201397899Y which was issued on Feb. 3, 2010, and the Mini DiiVA connector comprises two pairs of differential signal contacts for increasing the speed of signal transmission. However, because the Micro USB connector and Mini DiiVA connector are not compatible and can not mate with each other; and the Mini DiiVA connector would not fully replace the Micro USB connector in short period of time; then a new electrical connector is required be designed to be compatible to the Mini DiiVA connector and the Micro USB connector at the same time, and has a small volume to adapt a miniature development of the electronic industry.

Hence, an improved electrical connector is desired to overcome the above problems.

BRIEF SUMMARY OF THE INVENTION

According to the present invention, an electrical connector adapted for at least two different mating connectors, comprises an insulative housing and a plurality of contacts retained on the housing. The insulative housing has a base and a tongue forwardly extending from the base. Each contact has a retaining portion retained in the base, a contact portion extending to the tongue from one end of the retaining portion, and at least one soldering portion extending out of the insulative housing from another end of the retaining portion. The contacts comprise two pairs of outer contacts at two sides thereof and at least one middle contact between said two pairs of outer contacts for connecting with one contact of one mating connector or two contacts of another mating connector.

According to another aspect of the present invention, an electrical connector adapted for at least two different mating connectors, comprises an insulative housing, a plurality of contacts retained in the insulative housing, and a metal shell covering the insulative housing. The insulative housing has a base and a tongue forwardly extending from the base. Each contact has a contact portion extending to the tongue. The contacts comprise two pairs of outer contacts at two sides thereof and at least one middle contact between said two pairs of outer contacts. The metal shell has a top wall, a bottom wall and a pair of side walls. The bottom wall has an protruding portion upwardly protruding toward the tongue to form a first mating opening together with the top wall and side walls, and at least one downward recessed portion to form a second mating opening together with the top wall, two side walls and the protruding portion. The contour of the first mating opening corresponds to that of a standard Micro USB 2.0 receptacle connector.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details.

Figure 19:
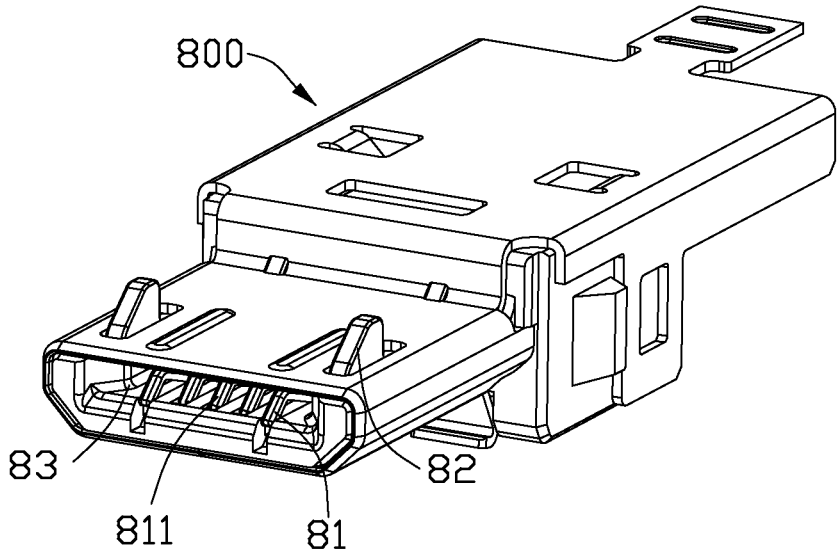
FIG. 19 is a perspective view of a standard Micro USB 2.0 plug connector.

Referring to FIGS. 1-8, an electrical connector 100 according to a first embodiment of the present invention is disclosed. The electrical connector 100 can be soldered to a circuit board (not shown) for being adapted for at least two different first and second mating connectors 800, 900. The first mating connector 800 is a standard Micro USB 2.0 plug connector which is shown in FIG. 19. The second mating connector 900 is a Mini DiiVA plug connector which is different from the first mating connector 800, and shown in FIG. 20. The Micro USB 2.0 plug connector comprises five contacts 81 which comprise a power contact, a pair of differential signal contacts, an ID contact and a grounding contact, and the spaces between adjacent contacts 81 are equal. The signal contacts include a middle signal contact 811 which is located in the middle of the five contacts 81. The Mini DiiVA plug connector 900 has six contacts 91 which comprise a pair of grounding contacts 912 and two pairs of differential signal contacts 911 at two sides of the grounding contacts 912, and the spaces between adjacent contacts 91 are equal. The first and second mating connectors 800, 900 have different contours. The electrical connector 100 comprises an insulative housing 1, a plurality of contacts 2 retained on the insulative housing 1, and a metal shell 3 covering the insulative housing 1.

Figure 4:
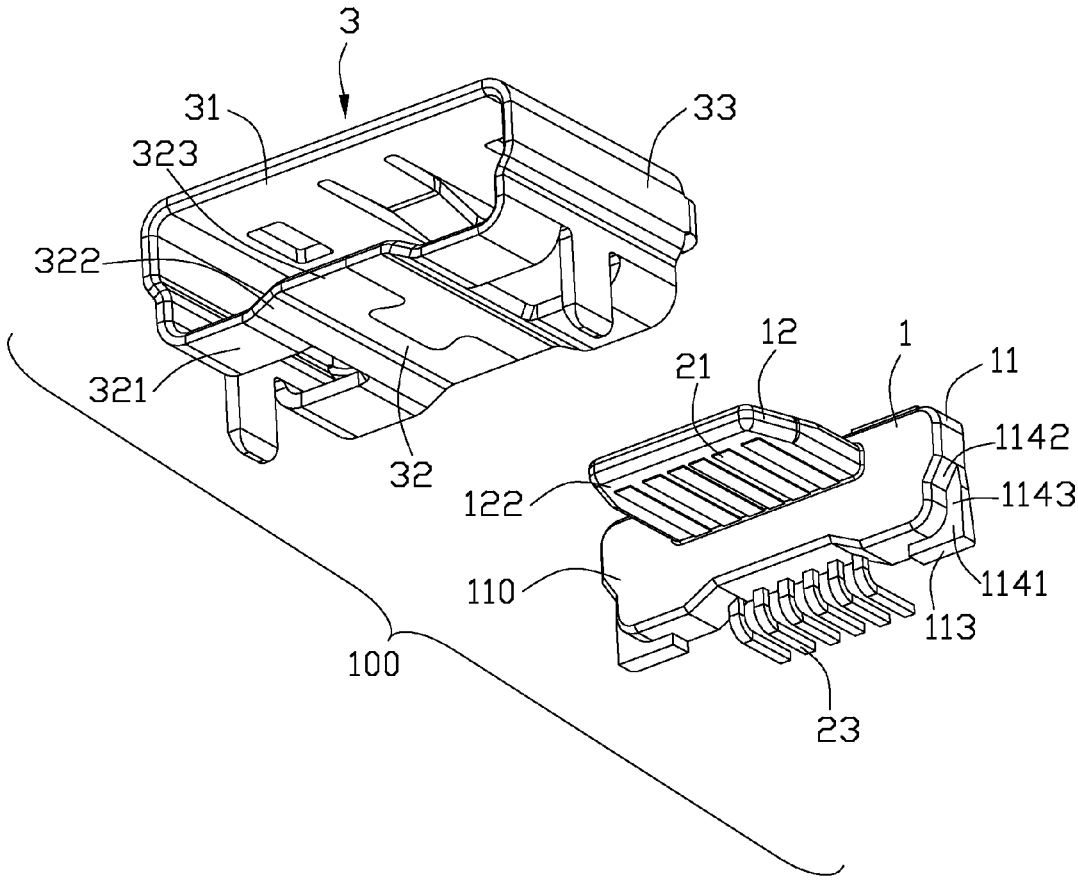
FIG. 4 is an exploded view of the electrical connector shown in FIG. 1.
Figure 5:
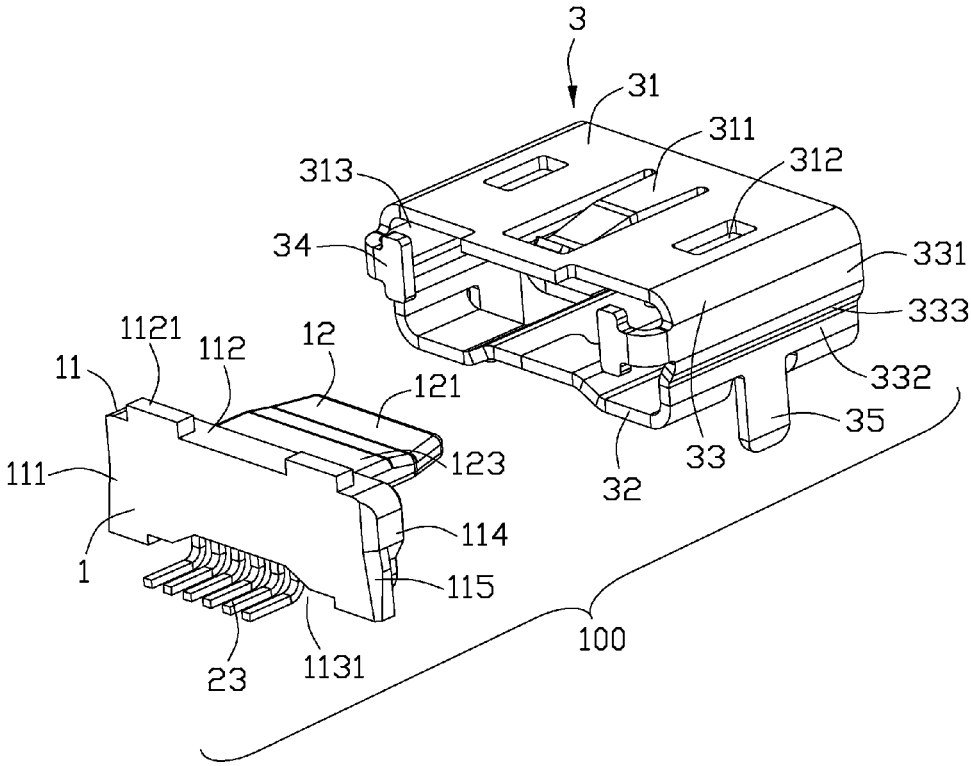
FIG. 5 is a view similar to FIG. 4, while taken from a different aspect.
Figure 6:
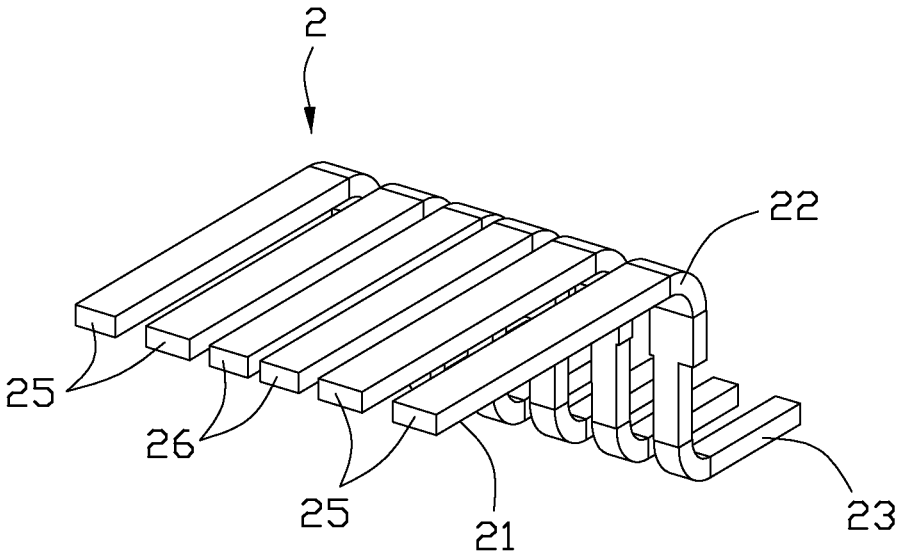
FIG. 6 is a perspective view of a plurality of contacts of the electrical connector shown in FIG. 1.
Figure 7:
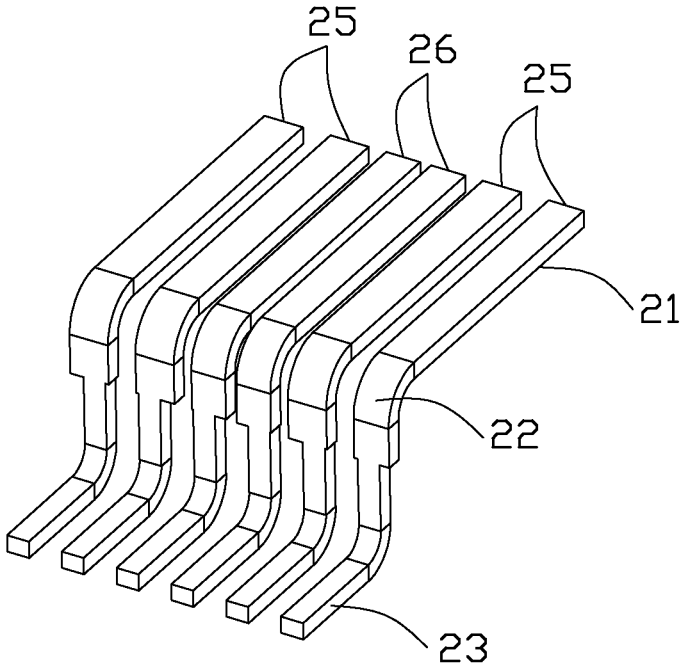
FIG. 7 is a view similar to FIG. 6, while taken from a different aspect.
Figure 20:
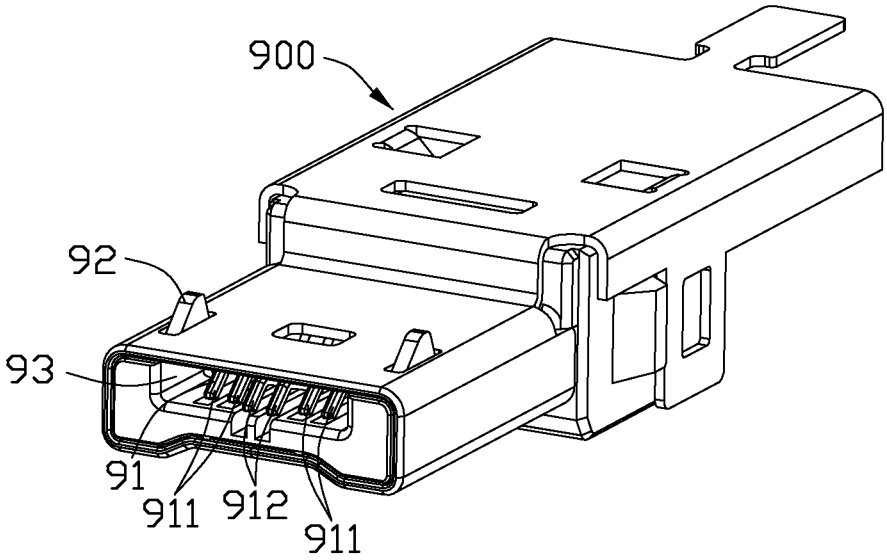
FIG. 20 is a perspective view of a Mini DiiVA plug connector.

Referring to FIGS. 4-5, conjoined with FIGS. 19-20, the insulative housing 1 has a base 11 and a tongue 12 forwardly extending from the base 11. The first mating connector 800 has a first cavity 83 to receive the tongue 12. The second mating connector 900 has a second cavity 93 to receive the tongue 12. The second cavity 93 is wider than the first cavity 83 along a transverse direction. The tongue 12 has a width and thickness which are compliance to that of a standard Micro USB 2.0 receptacle connector (not shown). Then the tongue 12 can be received in both the first and second cavities 83, 93. The tongue 12 has an upper surface 121, a lower surface 122 and a protrusion 123 upwardly protruding from a rear side of the upper surface 121 to stably retain the first and second mating connectors 800, 900.

The base 11 has a front surface 110, a rear surface 111, a top surface 112, a bottom surface 113 and two side surfaces 114. The tongue 12 extends from an upper side of the front surface 110. The base 11 has a pair of projections 1121 upwardly extending from the top surface 112 to engage with the metal shell 3. The base 11 has a pair of depressions 1141 depressed backwardly from a lower side of the front surface 110, and a recessed portion 1131 upwardly recessed from the bottom surface 113. The depression 1141 is formed with a winding inner surface 1142 and a resisting rear surface 1143 to resist a rear end of the metal shell 3. The contacts 2 are located in the recessed portion 1131 to prevent the insulative housing 1 from being destroyed in a soldering process of the contacts 2. The base 11 further has a pair of transitional surfaces 115 at two lateral sides of the rear surface 111 thereof.

Referring to FIGS. 4-8, and conjoined with FIGS. 19-20, the electrical connector 100 in the first embodiment has six said contacts 2 which are arranged in a row along the transverse direction. The contacts 2 are insert molded in the insulative housing 1, and comprise two pairs of outer contacts 25 and a pair of middle contacts 26 between two pairs of outer contacts 25. The middle contacts 26 can simultaneously connect with the middle signal contact 811 of the Micro USB 2.0 plug connector 800 or respectively connect with two middle grounding contacts 912 of the Mini DiiVA plug connector 900.

Each contact 2 has a retaining portion 22 insert molded in the base 11, a contact portion 21 forwardly extending to the tongue 12 from one end of the retaining portion 22, and a soldering portion 23 backwardly extending out of the insulative housing 1 from another end of the retaining portion 22. The contact portions 21 are arranged in a row at the lower surface 122 of the tongue 12 to make the tongue 12 have a small thickness. The soldering portions 23 are arranged in a row at a same horizontal surface to make the electrical connector 100 be surface mounted to the circuit board. All contact portions 21 have same width, and all soldering portions 23 have same width, then the contacts 2 can be conveniently produced. The arrangement of the soldering portions 23 is compliance to that of the Mini DiiVA receptacle connector (not shown), then an electronic device assembled with the electrical connector 100 of the present invention can be set with a current Mini DiiVA chip (not shown), which can effectively use current resource. The width of each contact portion 21 is larger than that of each contact 81, 91 of the Micro USB 2.0 and Mini DiiVA plug connectors 800, 900 for assuring that the contact portions 21 can electrically connect with the contacts 81, 91 of the Micro USB 2.0 or Mini DiiVA plug connector 800, 900. The width of each soldering portion 23 is narrower than that of each contact portion 21 for enlarging the distance between adjacent soldering portions 23.

Figure 8:
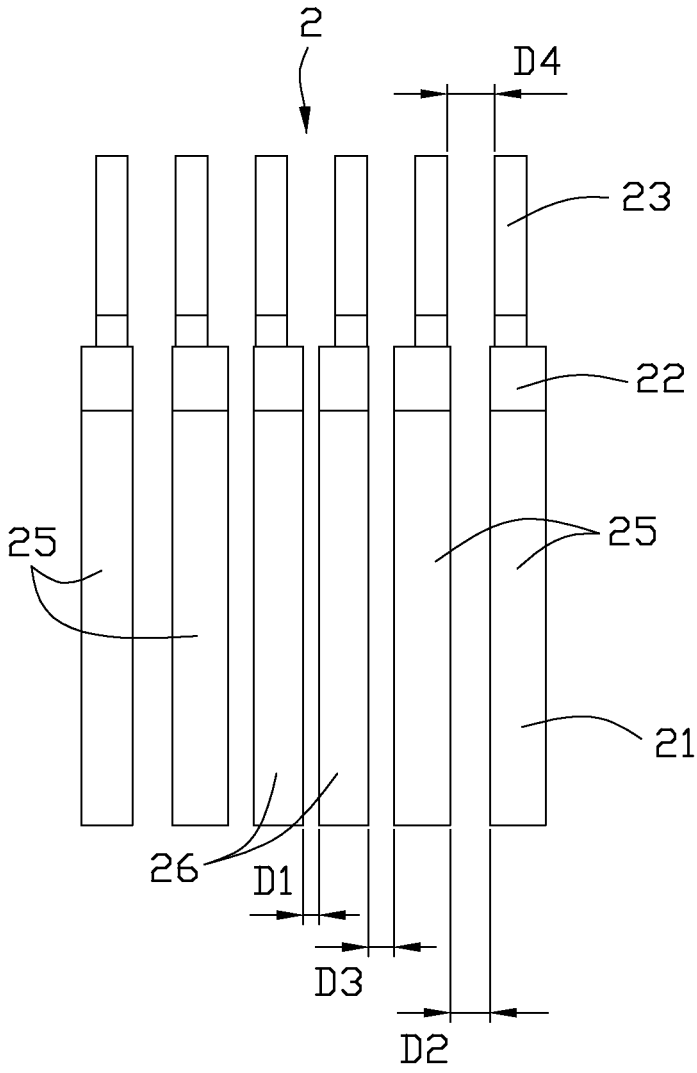
FIG. 8 is a top plan view of the contacts shown in FIG. 6.
Figure 9:
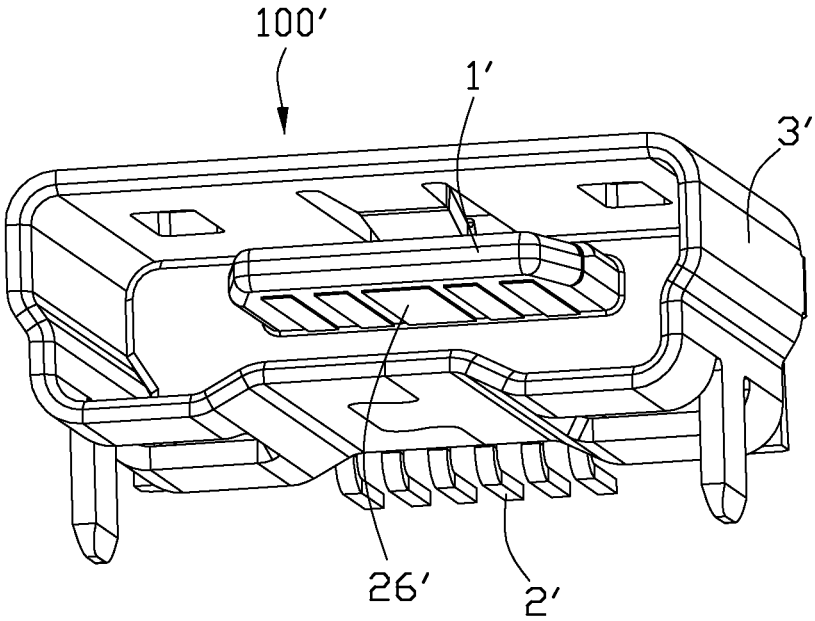
FIG. 9 is a perspective view of an electrical connector according to a second embodiment of the present invention.
Figure 10:
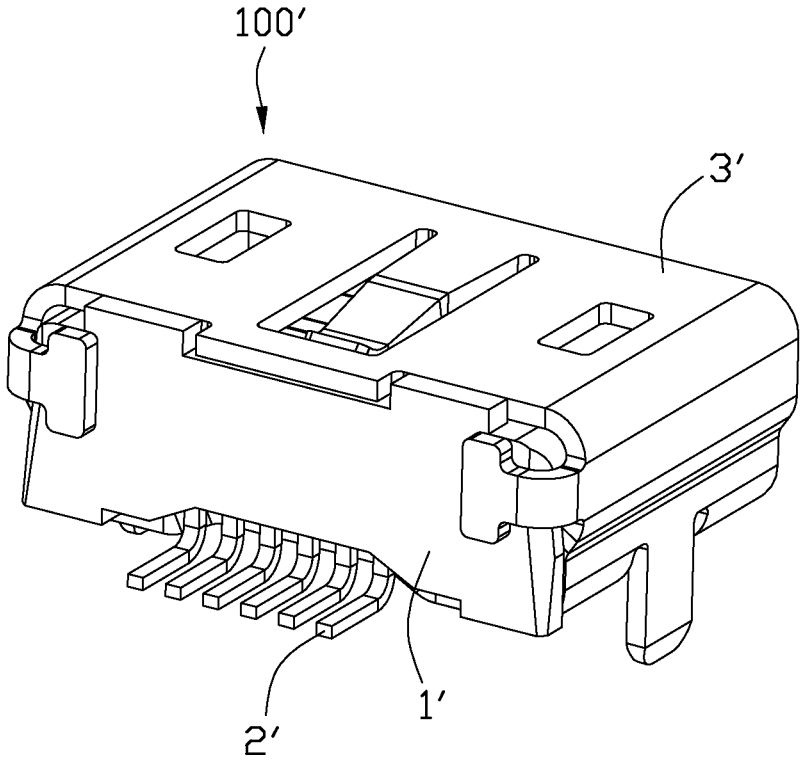
FIG. 10 is a view similar to FIG. 9, while taken from a different aspect.
Figure 11:
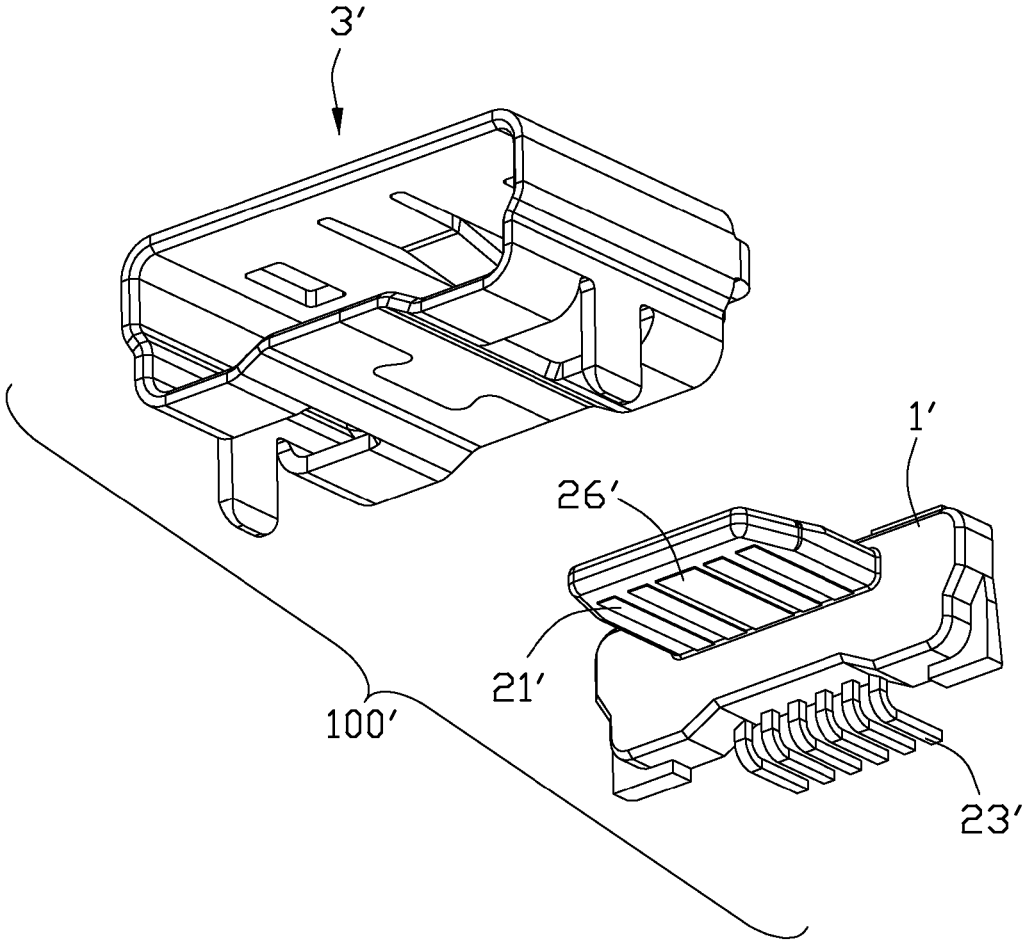
FIG. 11 is an exploded view of the electrical connector shown in FIG. 9.
Figure 12:
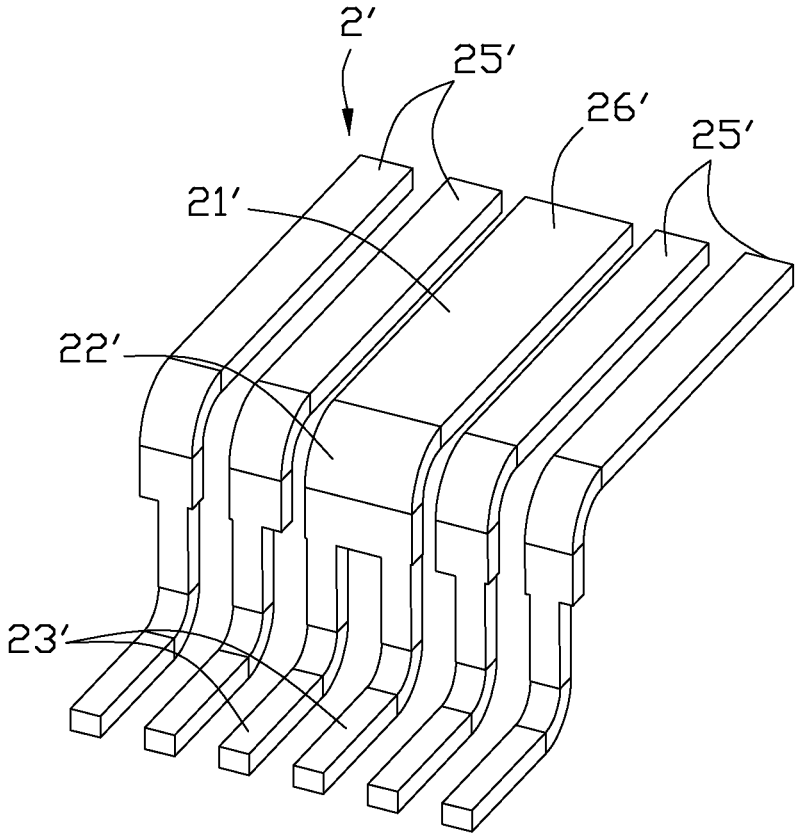
FIG. 12 is a perspective view of a plurality of contacts of the electrical connector shown in FIG. 9.
Figure 13:
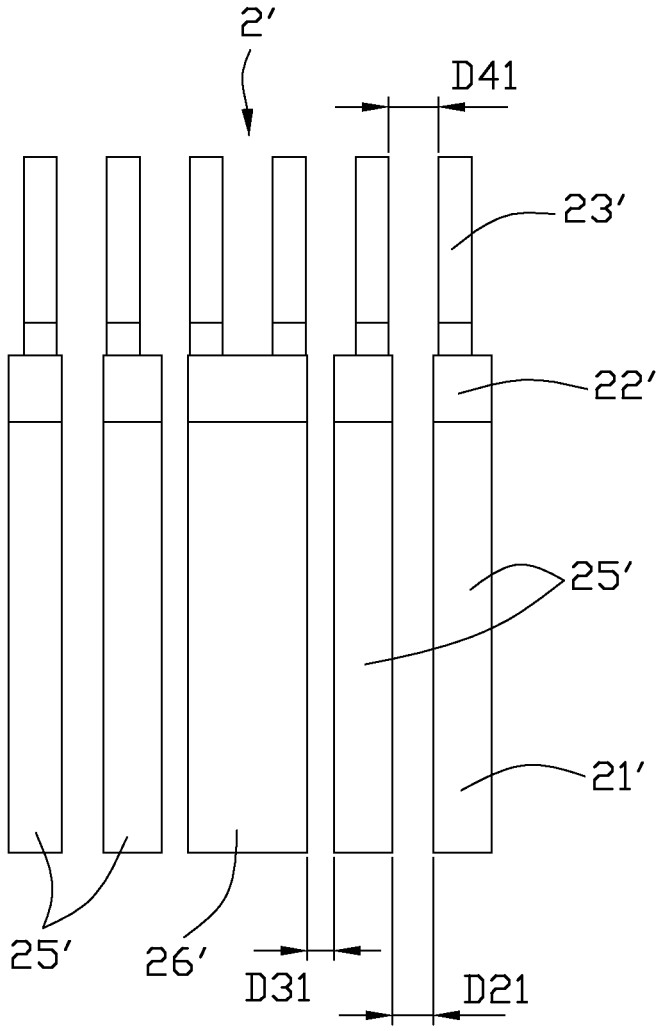
FIG. 13 is a top plan view of the contacts shown in FIG. 12.
Figure 14:
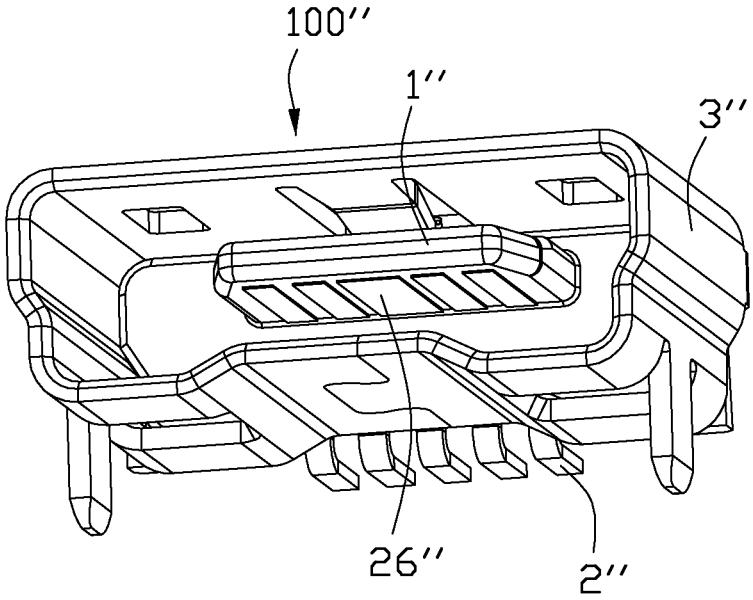
FIG. 14 is a perspective view of an electrical connector according to a third embodiment of the present invention.
Figure 15:
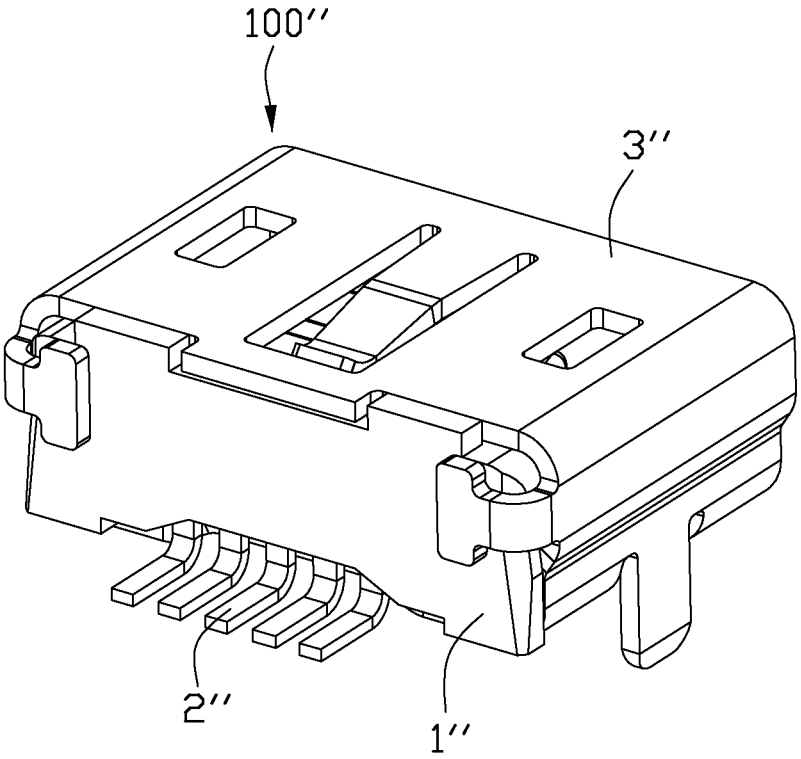
FIG. 15 is a view similar to FIG. 14, while taken from a different aspect.
Figure 16:
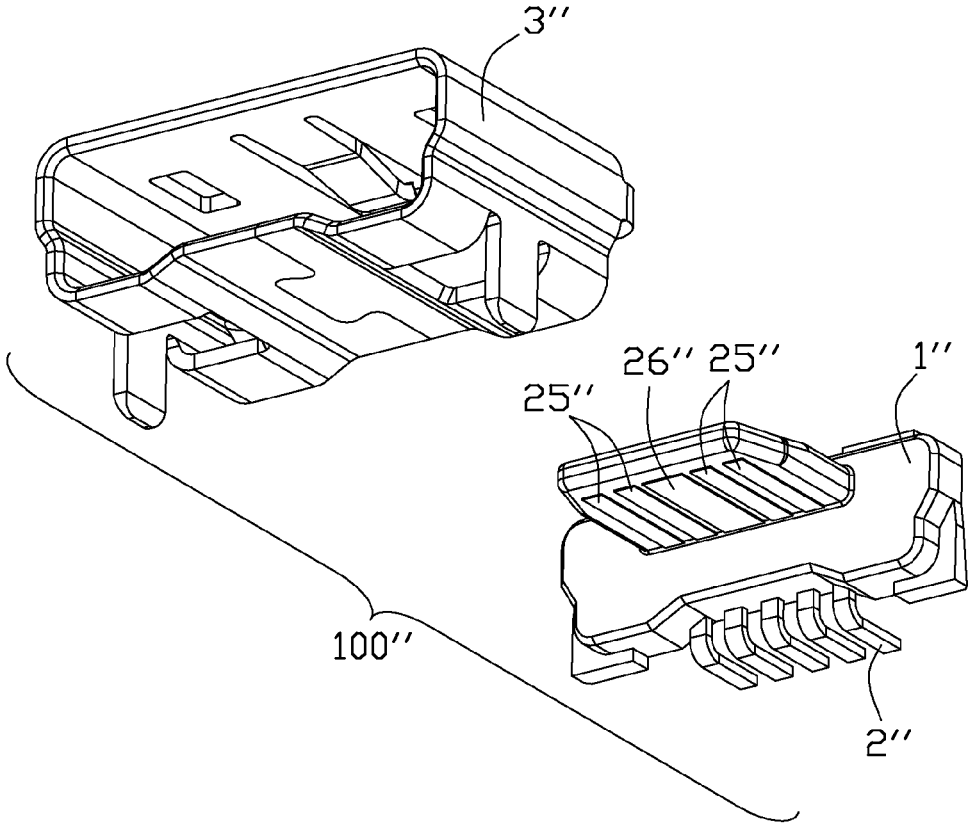
FIG. 16 is an exploded view of the electrical connector shown in FIG. 14.
Figure 17:
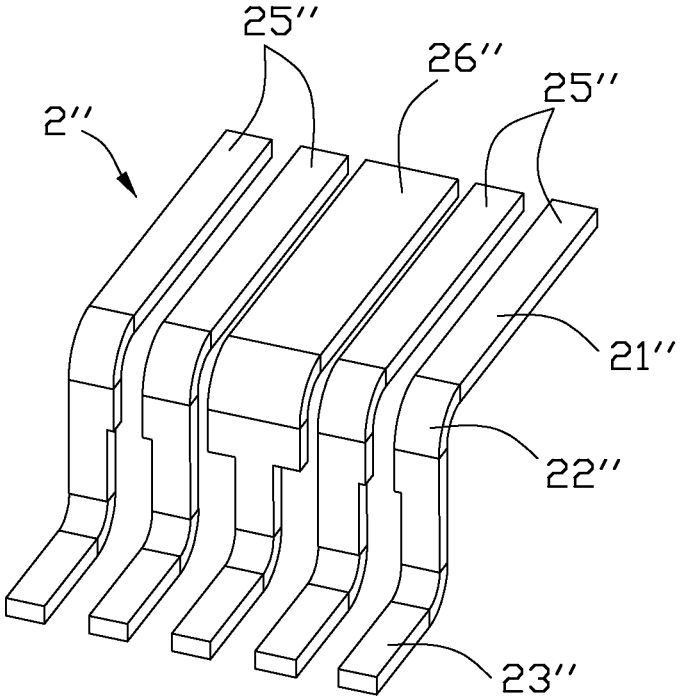
FIG. 17 is a perspective view of a plurality of contacts of the electrical connector shown in FIG. 14.
Figure 18:
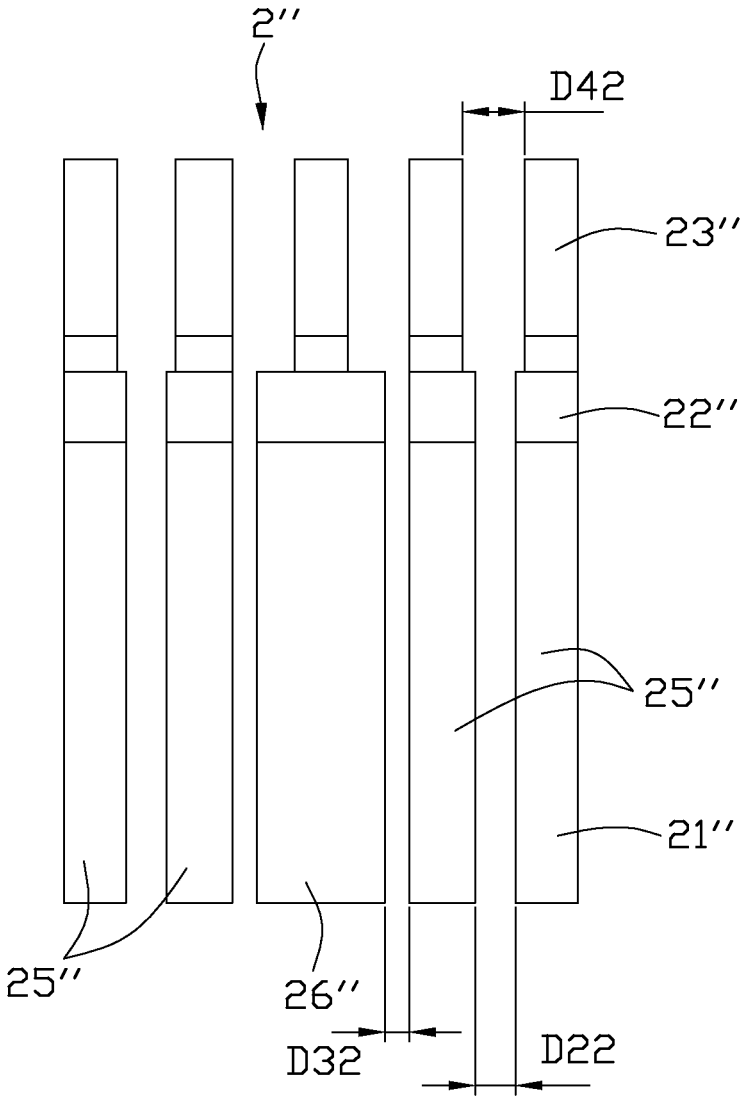
FIG. 18 is a top plan view of the contacts shown in FIG. 17.

Referring to FIG. 8, the contact portions 21 of two middle contacts 26 define a distance D1 therebetween along the transverse direction. The contact portions 21 of each pair of outer contacts 25 define another distance D2 therebetween along the transverse direction. The distance D2 is larger than the distance D1. The adjacent outer contact 25 and the middle contact 21 define a distance D3 which is larger than the distance D1 and smaller than the distance D2. The adjacent soldering portions 23 define a distance D4 therebetween along the transverse direction. The distance D4 is larger than the distances D1, D2 and D3. The distances D1, D2 and D3 are smaller than corresponding distance between adjacent contacts 81, 91 of Micro USB 2.0 or Mini DiiVA plug connectors 800, 900, which can make the electrical connector 100 of the first embodiment can mate with two different groups of contacts 81, 91 corresponding to the Micro USB 2.0 and Mini DiiVA plug connectors 800, 900 respectively.

Therefore, when the Micro USB 2.0 plug connector 800 is inserted into the electrical connector 100, the contact portions 21 of two pairs of outer contacts 25 can respectively connect with the power contact, one signal contact, the ID contact and the grounding contact of the Micro USB 2.0 plug connector 800 for transmitting power signal, data signal, ID signal and grounding signal. Besides, because the distance D1 between the contact portions 21 of the middle contacts 26 is smaller, thereby the contact portions 21 of the middle contacts 26 can simultaneously connect with the middle signal contact 811 of the Micro USB 2.0 plug connector 800. Then the middle contacts 26 can simultaneously connect with current Micro USB 2.0 chip (not shown) to transmit USB data signal, or only one middle contact 26 connect with the Micro USB 2.0 chip to transmit USB data signal.

When the electrical connector 100 mates with the Mini DiiVA plug connector 900, the contact portions 21 of two pairs of outer contacts 25 respectively connect with two pairs of differential signal contacts 911 of the Mini DiiVA plug connector 900 to transmit high frequency signal for being adapted for the development of electronic industry. The contact portions 21 of the middle contacts 26 connect with two grounding contacts 912 of the Mini DiiVA plug connector 900 to transmit grounding signals.

As fully described above, the electrical connector 100 is designed after long time studying, analyzing and testing to adapt all difference between the Micro USB 2.0 plug connector 800 and Mini DiiVA plug connector 900, then the electrical connector 100 not only can mate with the current Micro USB 2.0 plug connector 800 to adapt current electronic device, but also can mate with the Mini DiiVA plug connector 900 to achieve high speed signal transmission.

Figure 1:
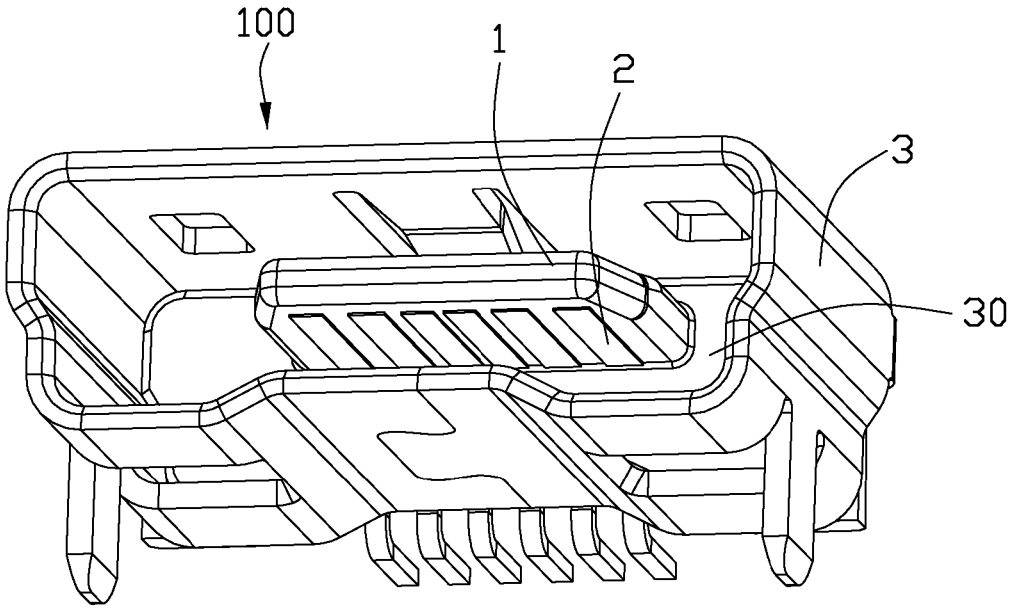
FIG. 1 is a perspective view of an electrical connector according to a first embodiment of the present invention.
Figure 2:
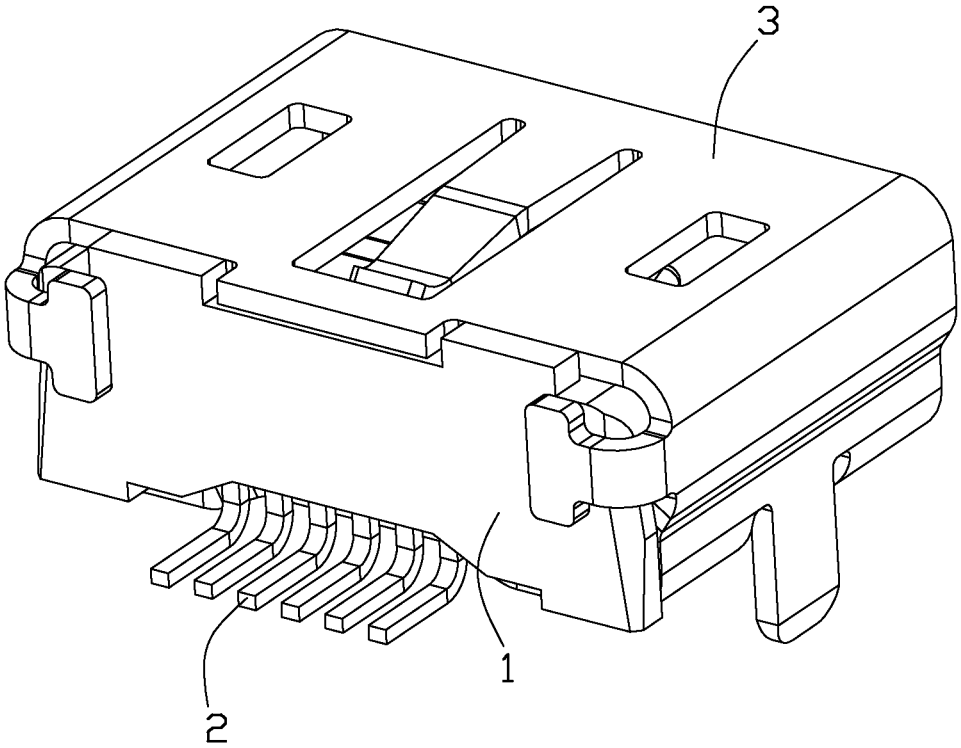
FIG. 2 is a view similar to FIG. 1, while taken from a different aspect.
Figure 3:
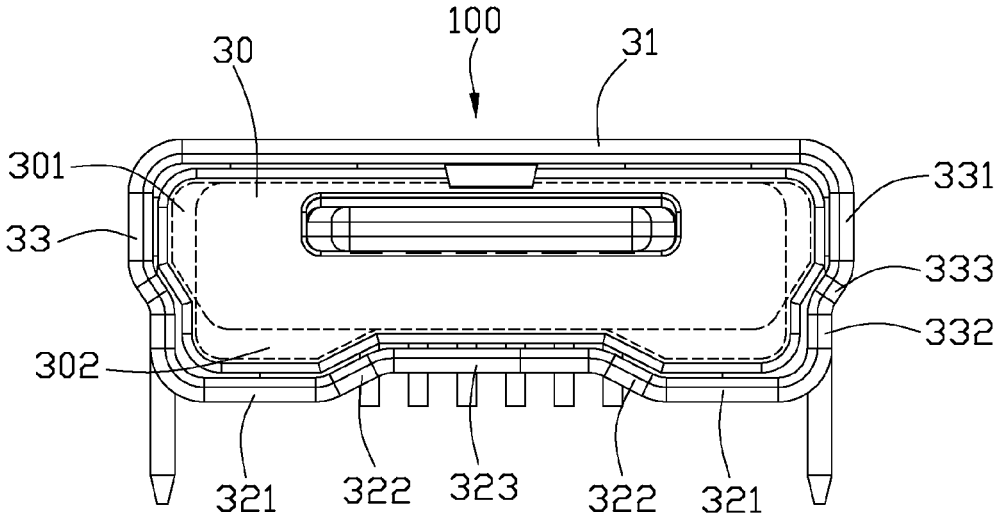
FIG. 3 is a front elevational view of the electrical connector shown in FIG. 1.

Referring to FIGS. 3-5, the metal shell 3 surrounds the tongue 12 to form a mating opening 30 between the metal shell 3 and the tongue 12 for receiving the mating connectors 800, 900. The metal shell 3 has a top wall 31 facing to the upper surface 121 of the tongue 12, a bottom wall 32 facing to the lower surface 122 of the tongue 12, and two side walls 33 connecting the top wall 31 and the bottom wall 32 together. The top wall 31 has a spring arm 311 extending backwardly, a pair of locking holes 312 at two sides of the spring arm 311, and two cutouts 313 forwardly recessed from a rear edge of the top wall 31. The spring arm 311 extends into the mating opening 30 to resist the mating connectors 800, 900. The locking holes 312 are used to lock with locking contacts 82, 92 of the mating connectors 800, 900. The cutouts 313 engage with the projections 1121 of the insulative housing 1 to prevent the metal shell 3 from moving backwardly.

The side wall 33 bends along the winding inner surface 1142 of the insulative housing 1 at a lower side thereof Each side wall 33 has a first side wall 331 perpendicularly connecting with the top wall 31, a second side wall 332 perpendicularly connecting with the bottom wall 332, and a third side wall 333 obliquely connecting the first side wall 331 and the second side wall 332. The top wall 31 is wider than the bottom wall 32 along the transverse direction, which makes the first side wall 331 is located at an outside of the second side wall 332. The first side wall 331 is parallel to the second side wall 332. Each side wall 33 further has a locking strip 34 inwardly extending from a rear end of the first side wall 331, and a mounting leg 35 downwardly extending from a lower end of the second side wall 332. The locking strip 34 engages with the transitional surface 115 and locks with the rear surface 111 of the base 11 for preventing the metal shell 3 from moving forwardly.

The bottom wall 32 has an upward protruding portion at a middle position thereof and two downward recessed portions at two sides of the protruding portion. Each recessed portion is formed with a first bottom wall 321 extending inwardly from a lower end of the second side wall 332 and an upwardly oblique second bottom wall 322 connecting with the protruding portion. The protruding portion presents as a platform to form a flat third bottom wall 323 which is parallel to the first bottom wall 321 and the top wall 31. The first bottom walls 321 are located in a same plane and have the same width along the transverse direction. The third bottom wall 323 defines a width which is larger than that of the first bottom wall 321. The top wall 31 and the upper surface 121 of the tongue 12 defines a distance which is smaller than that between the third bottom wall 323 and the lower surface 122 of the tongue 12 along an up to down direction perpendicular to the transverse direction. The third bottom wall 323 and two second bottom walls 322 are located below the tongue 12 and overlap with the tongue 12 along the up to down direction.

The mating opening 30 comprises a first mating opening 301 which is formed between the third bottom wall 323, the top wall 31, two first side walls 331, two third side walls 333 and the tongue 12, and a second mating opening 302 which is formed between two second side walls 332, the top wall 31, the whole bottom wall 32 and the tongue 12. The first mating opening 301 has a contour corresponding to that of the Micro USB 2.0 plug connector 800, and is used to mate with Micro USB 2.0 plug connector 800. The second mating opening 302 has a contour corresponding to the Mini DiiVA plug connector 900, and is used to mate with the Mini DiiVA plug connector 900.

When the Micro USB 2.0 plug connector 800 is inserted into the mating opening 30, the outsides of the Micro USB 20 plug connector 800 contact the inner walls of the first mating opening 301, and do not contact the second side walls 332, the first bottom walls 321 and the second bottom walls 322. When the Mini DiiVA plug connector 900 is inserted into the mating opening 30, the outsides of the Mini DiiVA plug connector 900 contact the inner walls of the second mating opening 302, and do not contact the first side walls 331, the third side walls 333. Therefore, the mating opening 30 between the top wall 31, the third bottom wall 323, the extension wall of the third side wall 333 between the second side wall 332 and the third bottom wall 323, the extension wall of the second side wall 332 between the top wall 31 and a lower end of the third side wall 333 is shared by the first and second mating openings 301, 302, and the shared mating opening 30 occupies two-thirds of the whole mating opening 30 for adapting the miniature development of the electronic industry.

Referring to FIGS. 9-13, the electrical connector 100' according to a second embodiment of the present invention is disclosed. The electrical connector 100' also comprises an insulative housing 1', a plurality of contacts 2' insert molded in the insulative housing 1' and a metal shell 3' covering the insulative housing V. The insulative housing 1' and the metal shell 3' are approximately same to that in the first embodiment. The contacts 2' comprise two pairs of outer contacts 25' same to that in the first embodiment. The difference between the electrical connectors 100, 100' in the first and second embodiment is that the contacts 2' has only one middle contact 26' to electrically connect with one middle contact of the Micro USB 2.0 plug connector 800 or two middle contacts of the Mini DiiVA plug connector 900.

The contact portion 21' of the middle contact 26' is wider than that of all outer contacts 25. The middle contact 26' has a pair of soldering portions 23' extending from two sides of the retaining portion 22'. The adjacent soldering portions 23' define a distance D41 which is equal to the distance D4 in the first embodiment. The contact portions 21' are wider than the soldering portions 23' along the transverse direction. The contact portions 21' of the middle contact 26' and an adjacent outer contact 25' defines a distance D31 therebetween. The contact portions 21' of the two adjacent outer contacts 25' define a distance D21 which is larger than the distance D31. The distance D41 is larger than the distances D21, D31.

When the Micro USB 2.0 plug connector 800 is inserted into the electrical connector 100', the contact portion 21' of the middle contact 26' electrically connect with the middle signal contact 811 of the Micro USB 2.0 plug connector 800, and the Micro USB 2.0 chip can alternatively connect with only one soldering portion 23' of the middle contact 26' or both soldering portions 23' of the middle contact 26'. When the Mini DiiVA plug connector 900 is inserted into the electrical connector 100', the contact portion 21' of the middle contact 26' connects with both middle grounding contacts 912 to transmit grounding signal.

Referring to FIGS. 14-18, an electrical connector 100" according to a third embodiment of the present invention is disclosed. The electrical connector 100" also comprises an insulative housing 1", a plurality of contacts 2" insert molded in the insulative housing 1", and a metal shell 3" covering the insulative housing 1". The insulative housing 1" and the metal shell 3" are approximately same to that in the second embodiment. The difference between the electrical connectors 100', 100" in the second and third embodiments is that: the middle contact 26" in the third embodiment only has one soldering portion 23" backwardly extending out of the insulative housing 1" from a rear middle position of the retaining portion 22". The soldering portions 23" of all contacts 2" have same width. Besides, the adjacent soldering portions 23" have equal distance D42 therebetween. Thereby the arrangement of the soldering portions 23" corresponds to that of the Micro USB 2.0 receptacle connector to electrically connect with current Micro USB 2.0 chip. In addition, the contact portions 21" of the adjacent middle contact 26" and the outer contact 25" defines a distance D32 which is smaller than a distance D22 defined between the contact portions 21" of each pair of outer contacts 25". The distance D42 is larger than the distances D22, D32.

When the Micro USB 2.0 plug connector 800 is inserted into the electrical connector 100", the contact portion 21" of the middle contact 26" electrically connect with the middle signal contact 811 of the Micro USB 2.0 plug connector 800, and the Micro USB 2.0 chip connect with the soldering portion 23" of the middle contact 26" directly. When the Mini DiiVA plug connector 900 is inserted into the electrical connector 100", the contact portion 21" of the middle contact 26" connects with both middle grounding contacts 912 to transmit grounding signals. Two grounding lines of the Mini DiiVA chip simultaneously connect with the soldering portion 23" of the middle contact 26".

As fully described above, the metal shell 3, 3', 3" of the electrical connector 100, 100', 100" is formed with two different mating openings 301, 302 for adapting two different mating connectors 800, 900, and two mating openings share two-thirds space of the mating opening 30, which can make the electrical connector 100, 100', 100' not only has a high speed transmission, but also has a small volume to adapt the development of the electronic industry.

As fully described above, the electrical connector 100, 100', 100" in the embodiments of the present invention are receptacle connector. Of course, the electrical connector 100, 100', 100" can alternatively be designed as plug connector, and the mating connectors would be receptacle connectors.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector adapted for at least two different mating connectors, comprising:

an insulative housing having a base and a tongue forwardly extending from the base;

a plurality of contacts, each contact having a retaining portion retained in the base, a contact portion extending to the tongue from one end of the retaining portion, and at least one soldering portion extending out of the insulative housing from another end of the retaining portion; and a metal shell surrounding the tongue, the metal shell has a bottom wall, the bottom wall has an upwardly protruding portion at a middle position thereof and two downward recessed portions are two sides of the protruding portion, the metal shell surrounds the tongue to define an opening, the opening has two mating openings for receiving said two different mating connectors, only one of the mating opening has a bottom contour complying to that the bottom wall, and the other mating opening is located completely above the protruding portion of the bottom wall and spaced with the recessed portions;

wherein the contacts comprise two pairs of outer contacts at two sides thereof and at least one middle contact between said two pairs of outer contacts, the contact portions of all of said contacts are exposed on a same face of the tongue for mating with both the different mating connectors;

wherein the contact portions of all contacts are arranged in a row at one surface of the tongue along an up to down direction;

wherein the electrical connector comprises two said middle contacts for simultaneously connecting with one contact of said one mating connector and respectively connecting with two contacts of said another mating connector; and wherein the contact portions of said middle contacts define a distance therebetween along a transverse direction perpendicular to the up to down direction, and the distance is smaller than that between the contact portions of each pair of outer contacts.

2. The electrical connector according to claim 1, wherein each of the outer contact and the middle contact has one said soldering portion corresponding to the contact portion thereof, and the distances between adjacent soldering portions are equal and larger than that between adjacent contact portions.

3. The electrical connector according to claim 1, wherein the contact portions of adjacent outer contact and middle contact define a distance which is smaller than that between the contact portions of each pair of outer contacts.

4. The electrical connector according to claim 1, wherein the shell further has a top wall opposite to the bottom wall and two opposite side walls connecting the top wall and the bottom wall, the side wall has a first side wall perpendicularly connecting with the top wall of the shell and an inclined side wall obliquely connecting with the first side wall and extending toward the protruding portion.

5. An electrical connector adapted for at least two different mating connectors, comprising:

an insulative housing having a base and a tongue forwardly extending from the base;

a plurality of contacts retained in the insulative housing, the contacts comprising two pairs of outer contacts at two sides thereof and at least one middle contact between said two pairs of outer contacts, and each contact having a contact portion extending to the tongue; and a metal shell covering the insulative housing and having a top wall, a bottom wall and a pair of side walls, the side walls connecting the top wall and the bottom wall, the bottom wall having an protruding portion upwardly protruding from a middle thereof toward the tongue to form a first mating opening together with the top wall and the side walls, and two downward recessed portions on two opposite sides of the protruding portion to form a second mating opening together with the top wall, two side walls and the protruding portion;

wherein the contour of the first mating opening corresponds to that of a standard Micro USB 2.0 receptacle connector, wherein the outer contacts and the at least one middle contact are all common mating conductors for both the two different mating connectors;

wherein the tongue is located in a shared space of the first mating opening and the second mating opening, one of the two different mating connectors is a micro USB plug; and wherein the electrical connector comprises two said middle contacts, and the contact portions of said middle contacts define a distance therebetween along a transverse direction perpendicular to an up to down direction, and the distance is smaller than that between the contact portions of each pair of outer contacts.

6. The electrical connector according to claim 5, wherein the electrical connector comprises only one said middle contact, the side wall has a first side wall perpendicularly connecting with the top wall and an inclined side wall obliquely connecting with the first side wall.

7. The electrical connector according to claim 5, wherein the base has a front surface, a rear surface, a top surface, a bottom surface and two side surfaces, an opening which consists of the first mating opening and the second mating opening is defined by the metal shell, an out line of the front surface is same as that of the opening, the base has a pair of depressions depressed backwardly from a lower side of the front surface, the depression is formed with a resisting rear surface to resist a rear edge of the metal shell.

8. An electrical connector system among a first receptacle connector and a corresponding mating first plug connector, and a second receptacle connector and a corresponding mating second plug connector for allowing the first receptacle connector to mutually exclusively mate with both the first and second plug connectors, said first receptacle connector including:

an insulative housing including a mating tongue;

a plurality of contacts disposed in the housing with contacting sections exposed upon the mating tongue;

a shell enclosing the mating tongue and defining a pair of opposite longitudinal sides spaced from each other in a first direction, and a pair of opposite transverse sides spaced from each other in a second direction perpendicular to said first direction, said longitudinal sides and said transverse sides linked to one another alternately; and a first one of the longitudinal sides extending in a straight manner along a longitudinal direction, which is same with the second direction, while a second one of the longitudinal sides extending in a double-offset manner along said longitudinal direction and having a middle sections closer to the first one of the longitudinal sides and a pair of side sections relatively farther from the first one of the longitudinal sides; wherein during mating with the first plug connector, both the middle section and the pair of side sections are configured to be engaged with the first plug connector; during mating with the second plug connector, only the middle section is configured to be engaged with the second plug connector while the side sections are not, under condition that second receptacle connector, which is configured to be snugly compliantly mated with the second plug connector, is not configured to be allowed to be mated with the first plug connector; wherein the contacts of the first receptacle connector includes two pairs of outer contacts commonly sandwiching at least one middle contact which is essentially aligned with the middle section in a vertical direction which is same with the first direction; wherein a pair of oblique sections are located between the middle section and the pair of side sections, and the dimension of the mating tongue in the longitudinal direction is essentially same to a sum of the middle section and the pair of oblique sections; and wherein a pair of chamfered structures are respectively formed on the corresponding pair of transverse sides and located between the corresponding pair of longitudinal sides.

9. The electrical connector system as claimed in claim 8, wherein said pair of chamfered structures are space from at least one of said pair of longitudinal sides.

10. The electrical connector system as claimed in claim 8, wherein the outermost two contacts of the first receptacle connector are essentially respectively aligned with the pair of oblique sections in a vertical direction which is same with the first direction.

11. The electrical connector system as claimed in claim 8, wherein a mating portion of the first plug connector is larger than that of the second plug connector in the longitudinal direction.

* * * * *